US007686163B2

(12) United States Patent
Chang

(10) Patent No.: US 7,686,163 B2
(45) Date of Patent: Mar. 30, 2010

(54) ERGONOMIC GOLF BAG HANDLE

(75) Inventor: Frank I Teh Chang, Kowloon (HK)

(73) Assignee: Jimmy Cheuk Tsang, Hong Kong (HK)

( * ) Notice: Subject to any disclaimer, the term of this patent is extended or adjusted under 35 U.S.C. 154(b) by 772 days.

(21) Appl. No.: 11/125,038

(22) Filed: May 9, 2005

(65) Prior Publication Data

US 2006/0249552 A1 Nov. 9, 2006

(51) Int. Cl.
*A63B 55/00* (2006.01)
*A63B 55/06* (2006.01)

(52) U.S. Cl. ..... 206/315.6; 206/315.3; 206/315.7; 224/627; 224/259

(58) Field of Classification Search ..... 206/315.2, 206/315.3, 315.6, 315.7; 211/70.2; 224/259, 224/627, 274
See application file for complete search history.

(56) References Cited

U.S. PATENT DOCUMENTS 646,869 A * 4/1900 Perkes ..... 206/315.2
649,869 A 5/1900 Heissenberger
699,391 A 5/1902 Johnson
1,404,559 A 1/1922 Watrous
1,681,225 A 8/1928 Earl
1,727,578 A 9/1929 Wengard
1,790,092 A 1/1931 Duguid et al.
1,809,120 A 6/1931 Hall
1,936,021 A 11/1933 Hutchinson
2,186,491 A 1/1940 Meyer
2,256,521 A 9/1941 Kirkpatrick et al.
2,533,440 A 12/1950 Endee
2,676,737 A 4/1954 Zirbel
2,739,631 A 3/1956 Hamley
2,820,498 A 1/1958 Endee
2,853,111 A 9/1958 Williams
2,970,629 A 2/1961 Masten
3,521,689 A 7/1970 Woods, Jr.
3,746,204 A * 7/1973 Nagai ..... 220/592.2
4,155,387 A 5/1979 Costa
4,383,563 A * 5/1983 Kirchhoff, Jr. ..... 206/315.2
4,685,561 A 8/1987 Reimers
4,763,763 A 8/1988 Sadow
4,767,001 A * 8/1988 Kim ..... 206/315.3
4,828,081 A 5/1989 Nordstrom et al.
4,834,235 A * 5/1989 Solheim et al. ..... 206/315.7
4,905,827 A * 3/1990 Kim ..... 206/315.3

(Continued)

FOREIGN PATENT DOCUMENTS

JP 2002210053 A * 7/2002

*Primary Examiner*—Sue A Weaver
(74) *Attorney, Agent, or Firm*—Studebaker & Brackett PC; Donald R. Studebaker

(57) ABSTRACT

Embodiments of the present invention include an ergonomic golf bag handle. Further embodiments of the present invention provide a golf bag including the ergonomic golf bag handle thereon. In one embodiment, the golf bag handle is integrated into a top divider section of the golf bag. In another embodiment, the golf bag handle is angled with respect to the golf bag. Embodiments of the present invention also include a method comprising integrating the golf bag handle into the top divider section of the golf bag. Yet further embodiments of the present invention provide a method of using a golf bag, including gripping the ergonomically-designed and comfortable golf bag handle.

21 Claims, 9 Drawing Sheets

U.S. PATENT DOCUMENTS

| | | | | |
|---|---|---|---|---|
| RE33,203 | E | 4/1990 | Reimers | |
| 5,002,185 | A * | 3/1991 | Schurman | 206/315.4 |
| 5,038,984 | A | 8/1991 | Izzo | |
| 5,042,703 | A | 8/1991 | Izzo | |
| 5,042,704 | A | 8/1991 | Izzo | |
| 5,129,564 | A | 7/1992 | Danezin | |
| 5,178,273 | A * | 1/1993 | Igarashi | 206/315.7 |
| D335,741 | S | 5/1993 | McCormick et al. | |
| 5,221,030 | A | 6/1993 | Cretinon | |
| D339,226 | S | 9/1993 | Quellais et al. | |
| 5,314,079 | A | 5/1994 | Young | |
| 5,390,788 | A | 2/1995 | Schenkkan | |
| 5,450,955 | A * | 9/1995 | Olson | 206/315.6 |
| D362,752 | S | 10/1995 | Steurer | |
| 5,465,839 | A * | 11/1995 | Gretz | 206/315.3 |
| 5,474,176 | A | 12/1995 | Schenkkan | |
| 5,499,761 | A | 3/1996 | Reimers | |
| 5,725,095 | A * | 3/1998 | Beck et al. | 206/315.8 |
| 5,813,527 | A | 9/1998 | Henrickson | |
| 6,006,974 | A | 12/1999 | Varney et al. | |
| 6,199,690 | B1 | 3/2001 | Shin | |
| D444,931 | S | 7/2001 | Vong et al. | |
| D446,478 | S | 8/2001 | Wu | |
| 6,450,334 | B1 | 9/2002 | Chang | |
| 6,457,620 | B1 | 10/2002 | Batten et al. | |
| 6,491,197 | B1 | 12/2002 | Walker | |
| 6,510,944 | B2 | 1/2003 | Chang | |
| 6,550,793 | B2 | 4/2003 | Carter | |
| 6,607,076 | B1 * | 8/2003 | Smith | 206/315.6 |
| D482,836 | S | 11/2003 | Van Landingham, Jr. | |
| 6,640,970 | B1 * | 11/2003 | Townsend, Jr. | 206/315.2 |
| 6,712,206 | B2 * | 3/2004 | Chen | 206/315.7 |
| 6,761,368 | B2 | 7/2004 | Carter | |
| 6,883,591 | B2 | 4/2005 | Lai | |
| 6,892,773 | B1 | 5/2005 | Wenzler | |
| D515,316 | S | 2/2006 | Chang | |
| D520,751 | S | 5/2006 | Chang | |
| D528,800 | S | 9/2006 | Liu et al. | |
| D557,012 | S | 12/2007 | Chang | |
| 2002/0078531 | A1 | 6/2002 | Chen | |
| 2002/0096443 | A1 * | 7/2002 | Chang | 206/315.3 |
| 2002/0130476 | A1 | 9/2002 | Carter | |
| 2003/0121942 | A1 | 7/2003 | Chang | |
| 2003/0184033 | A1 | 10/2003 | Carter | |
| 2004/0035728 | A1 * | 2/2004 | Ortega | 206/315.3 |
| 2004/0035729 | A1 | 2/2004 | Chang et al. | |
| 2004/0089569 | A1 | 5/2004 | Chang | |
| 2004/0089686 | A1 | 5/2004 | Pratt et al. | |
| 2004/0178093 | A1 * | 9/2004 | Reimers | 206/315.3 |
| 2004/0178094 | A1 * | 9/2004 | Reimers | 206/315.3 |
| 2005/0056603 | A1 * | 3/2005 | Laud | 211/70.2 |
| 2005/0092630 | A1 * | 5/2005 | Chen | 206/315.6 |
| 2005/0109805 | A1 | 5/2005 | Pratt et al. | |
| 2005/0155882 | A1 | 7/2005 | Pratt et al. | |
| 2005/0279795 | A1 * | 12/2005 | Campbell et al. | 224/629 |

* cited by examiner

--Prior Art--

--Prior Art--

--Prior Art--

--Prior Art--

--Prior Art--

--Prior Art--

ERGONOMIC GOLF BAG HANDLE

BACKGROUND OF THE INVENTION

1. Field of the Invention

Generally, embodiments of the present invention relate to handles for use in carrying bags capable of containing sports equipment. More specifically, embodiments of the present invention relate to handles for golf bags.

2. Description of the Related Art

In the sporting goods industry, bags for containing and transporting sports equipment are well known. Particularly, in the sport of golf, golf bags are utilized for holding and transporting golf clubs, golf balls, golf tees, and other golf equipment. The user utilizes the golf bag to carry the golf equipment from one place to another.

A typical golf bag 10, which is shown in FIG. 1, includes multiple rigid support bars (not shown) located parallel to one another at a distance from one another. The support bars, which are connected at one end to a base 11 and at the other end to a top divider section 12 of the golf bag 10, perform as the structural supports for the golf bag 10. Other golf bags (not shown) possess alternate types of structural supports for the golf bags, including polytubes/sheets of plastic. The base 11 is usually constructed from a rigid material, such as plastic, and is used as the resting point for the golf bag 10 on the ground when the golf bag 10 is placed on the ground. The top divider section 12 of the golf bag 10 is typically divided into multiple sections to allow the user to separate the golf clubs placed within the golf bag 10 from one another as desired.

Extending around the support bars of the typical golf bag 10 is a bag portion 13 which often is constructed from a cloth material. The bag portion 13 of the golf bag 10 is connected to the top divider section 12 at its upper end and connected to the base 11 at its lower end. In between the base 11 and the top divider section 12 of the golf bag 10, one or more pockets 14, 15 are connected to the outside of the bag portion 13 to allow the user to house golf balls, tees, and other golf equipment within the pockets 14, 15.

Golf bags customarily include a stand 16, one or more shoulder straps 17, 20 (see FIGS. 5 and 6), and a handle 18 thereon. FIG. 1 shows a representative stand 16. The stand 16, which when activated allows the golf bag 10 to stand generally upright and in place without human or any other outside support, is connected to the outside of the bag portion 13 of the golf bag 10. One variation of the stand 16 consists of three rigid stand legs (not shown in FIG. 1). Usually, this stand 16 acts as a tripod, so that when the golf bag 10 is being lifted by the user, the three stand legs are pivoted inward and disposed substantially in line with one another and in line with and proximate to the bag portion 13. In contrast, when the stand 16 is activated to support the golf bag 10, two of the stand legs are pivoted outward with respect to the remaining leg, and the golf bag 10 is supported in an angled position by the three stand legs in cooperation. To activate the stand 16, the two legs are pivoted outward by the user with respect to the remainder of the golf bag 10.

The shoulder strap 17, 20, which is shown in FIGS. 5 and 6, allows a user 19 to carry the golf bag 10 by resting the shoulder strap 17, 20 on one or more of his or her shoulders. Conventionally, the shoulder strap 17, 20 is constructed from a flexible cloth material. The shoulder strap 17, 20 is connected at its upper end to the bag portion 13 near the top divider section 12 and at its lower end to a mid-section of the bag portion 13 of the golf bag 10, so that the shoulder strap 17, 20 runs substantially parallel to the support bars (not shown) located within the golf bag 10. The shoulder strap 17, 20 of the typical golf bag 10 comes in one of two configurations. In the first configuration of the shoulder strap 17, shown in FIG. 5, a single strap extends between the two connected portions of the shoulder strap 17 to the bag portion 13. This configuration allows the user 19 to carry the golf bag 10 on one shoulder and at a side of the user's body.

In a second configuration, shown in FIG. 6, the shoulder strap 20 enables the user 19 to transport the golf bag 10 by placing portions of the shoulder strap 20 on both shoulders, thereby allowing the user 19 to carry the golf bag 10 on his or her back. The shoulder strap 20 is placed around both shoulders of the user 19 so that the user 19 may distribute the load of the golf bag 10 like a backpack.

To enable the user to carry the golf bag 10 by gripping a portion of the golf bag 10 with his or her hand, the typical golf bag handle 18 is connected to the outside of the bag portion 13 of the golf bag 10 as shown in FIGS. 1-6. Usually, the golf bag handle 18, which is constructed from a cloth material or other soft type of material, is disposed in line with the shoulder strap 17, 20 and also in line with the support bars (not shown) located within the golf bag 10. The location of the customary golf bag handle 18 on the bag portion 13 is between the top divider section 12 and the base 11 of the golf bag 10. The golf bag handle 18 is usually connected to the bag portion 13 using a soft, webbed connection and at a location below the top divider section 12 at about one-third of the distance between the top divider section 12 and the base 11 of the golf bag 10, as shown in FIGS. 1-6. More specifically, as illustrated in FIG. 1, an upper end 23 of the typical golf bag handle 18 is located on the bag portion 13 at a distance D1 from the top divider section 12 of approximately 4-5 inches, while a lower end 25 of the golf bag handle 18 is located on the bag portion 13 at a distance D2 from the top divider section 12 of approximately 9-10 inches.

Prior art golf bags are disadvantageous because the location of the golf bag handle 18 on the golf bag 10 and the angle of location of the golf bag handle 18 with respect to the golf bag 10 result in discomfort to the user 19, as depicted in FIGS. 1-6. First, the location of the golf bag handle 18 on the golf bag 10 provides discomfort to the user 19 while the user 19 is carrying the golf bag 10 using the handle 18. FIG. 2 shows the typical golf bag 10 being carried by the user 19 with the handle 18. A user's arm 26 is shown in the typical user's carrying position. As illustrated in FIG. 2, the undesirable weight distribution of the golf bag 10 when golf clubs 27 are located in the golf bag 10 causes the front end of the golf bag 10, e.g., the portion of the golf bag 10 having the top divider portion 13, to rest at a lower position than the rear end of the golf bag 10, e.g., the portion of the golf bag 10 having the base 11, when the user 19 is carrying the golf bag 10 using the handle 18 in the normal, comfortable carrying position. In fact, as shown in FIG. 3, the typical distribution of weight when the user 19 is carrying the golf bag 10 by the golf bag handle 18 in the comfortable carrying position is 60/40, where approximately 60% of the load of the golf bag 10 is disposed on the front portion of the golf bag 10 and approximately 40% of the load of the golf bag 10 is disposed on the rear portion of the golf bag 10, where the front and rear portions are divided by a line L through an approximate center of the golf bag handle 18. Thus, because of the weight distribution of the golf bag 10 with respect to the golf bag handle 18, in the comfortable carrying position for the user 19, the golf clubs 27 are in danger of falling out from the front of the golf bag 10, possibly resulting in damage to the golf clubs 27.

To prevent the golf clubs 27 from falling out of the golf bag 10, the user 19 therefore must bend his or her arm 26 at the elbow to elevate the front end of the golf bag 10 relative to the rear end of the golf bag 10. This carrying position assumed by the user 19 is uncomfortable and not ergonomic.

Second, the location of the golf bag handle 18 on the golf bag 10 is disadvantageous because the handle 18 is not in a fixed location relative to the golf bag 10. The flexible nature of the handle 18, as well as the flexible nature of the cloth material of the bag portion 13 to which the handle 18 is attached, allow the handle 18 to move relative to the remainder of the golf bag 10. Therefore, the load distribution of the golf bag 10 is not readily predicable and adjustable by the user 19 while carrying the golf bag 10, and even if the user 19 is capable of adjusting the load of the golf bag 10, the user 19 will not ultimately upon adjustment be carrying the golf bag 10 in the optimal, comfortable carrying position of the arm 26 illustrated in FIG. 2.

The location of the golf bag handle 18 on the golf bag 10 is further disadvantageous when the user 19 is transferring the golf bag 10 between carrying positions. First, as illustrated in FIG. 5, the user 19 must at multiple times while golfing and/or carrying the golf bag 10 remove the golf bag 10 from his or her shoulder to either place the golf bag 10 on the ground or to change carrying modes by gripping the handle 18 by his or her hand. The location of the handle 18 forces the user 19 to bend his or her arm 26 backward and further bend the arm 26 at the elbow to transfer the load of the golf bag 10 from the shoulder of the user 19 to the hand of the user 19. This backward bending of the arm 26 is uncomfortable and not ergonomic for the user 19. This same discomfort results when the user 19 transfers the golf bag 10 from gripping with his or her hand on the handle 18 to placing the golf bag 10 on his or her shoulder with the shoulder strap 17.

Additionally, the location of the handle 18 is disadvantageous when the user 19 must transfer the golf bag 10 from both shoulders to the hand-carrying position obtained by the hand gripping the handle 18 or must transfer the golf bag 10 from both shoulders to the ground. As depicted in FIG. 6, the handle 18 is located behind the back of the user 19 and forces the user 19 to bend the arm 26 very far backwards behind his or her back when transferring the load of the golf bag 10 from the backpack shoulder strap position to the hand-carrying position. The same discomfort for the user 19 results when transferring the load of the golf bag 10 from the hand of the user 19 to the shoulder of the user 19.

Finally, the prior art golf bag handle 18 is disadvantageous because the user 19 must crouch to pick up the prior art golf bag 10 by the handle 18 or to activate the stand 16 when the golf bag 10 is resting on a surface. FIG. 4 illustrates this uncomfortable position for the user 19 when bending down to pick up the golf bag 10 by the handle 18 or to activate the stand 16. Activation of the stand 16 of the typical golf bag 10 requires the user 19 to rest his or her hand(s) on the top of the golf bag 10 and to push to activate the stand 16, which requires the user 19 to crouch or bend to activate the stand 16.

It is therefore desirable to provide a golf bag having a golf bag handle which allows for ergonomically pleasing and comfortable carrying of the golf bag by the user. It would be further advantageous to provide a golf bag handle for a golf bag which allows for comfortable and ergonomic carrying and transporting of the golf bag while the arm of the user is in the optimal position and the golf bag is carried by placing the user's hand in the golf bag handle. Moreover, it is desirable to provide a golf bag handle which allows for comfortable and ergonomic carrying and transporting of the golf bag while the user is carrying the golf bag using the handle with the user's arm in the optimal carrying position without the golf clubs falling from the golf bag.

It is also desirable to provide a golf bag handle which provides a favorable load distribution of the golf bag for comfortable carrying of the golf bag when the user is transporting the golf bag with the user's hand gripping the handle with the user's arm in the optimal carrying position.

It is further desirable to provide a golf bag handle which permits comfortable and ergonomic transferring of the golf bag from a first position where the load is supported on one or more of the user's shoulders with the shoulder strap to a second position where the load is supported by the user's hand in the handle. Additionally, it is desirable to provide a golf bag handle which allows for comfortable and ergonomic transferring of the golf bag from the second position to the first position.

It is further desirable to provide a golf bag handle which is sufficiently anchored to the golf bag to allow for comfortable carrying of the load of the golf bag using the handle.

It is additionally desirable to provide a golf bag handle with which the user may pick up the golf bag when the stand is activated or with which the user may activate the stand of the golf bag without crouching.

SUMMARY OF THE INVENTION

It is therefore an object of embodiments of the present invention to provide a golf bag handle which is ergonomic and comfortable for the user.

It is a further object of embodiments of the present invention to provide a golf bag which incorporates the golf bag handle.

It is a further object of embodiments of the present invention to provide a golf bag handle of the above type which is optimally located on the golf bag to supply optimal user comfort when performing activities associated with the sport of golf.

It is a further object of embodiments of the present invention to provide a golf bag handle of the above type which permits carrying of the golf bag using the golf bag handle with the user's arm in the optimal position for comfortable carrying of the golf bag without the equipment within the golf bag falling from the golf bag.

It is a further object of embodiments of the present invention to provide a golf bag handle of the above type which optimally distributes a load of the golf bag while the user carries the golf bag in the position of optimal comfort for the user's arm.

It is a further object of embodiments of the present invention to provide a golf bag handle of the above type which permits more ergonomically pleasing and comfortable transferring of the load of the golf bag between the shoulder of the user and the hand of the user, and vice versa.

It is a further object of embodiments of the present invention to provide a golf bag handle of the above type which is sufficiently anchored to the golf bag to allow for stable and predictable distribution of the load of the golf bag when carrying the golf bag with the user's hand using the handle.

It is a further object of embodiments of the present invention to provide a golf bag handle of the above type which also integrally operates the stand.

It is yet a further object of embodiments of the present invention to provide a golf bag handle of the above type which permits the user to activate the stand to stand the golf bag upright or to lift the golf bag using the handle without the user bending over in an uncomfortable position.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 7:
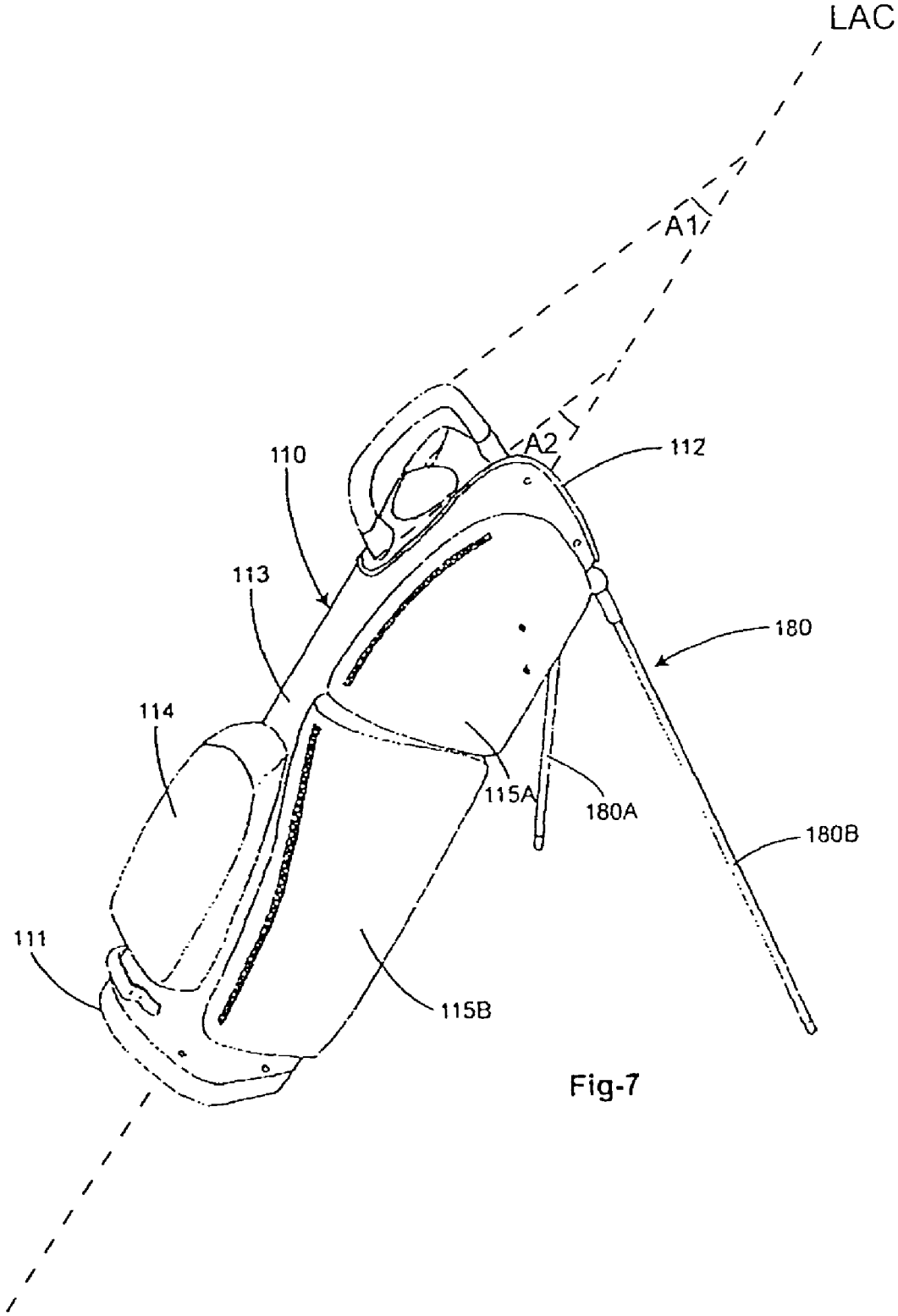
FIG. 7 is a side view of an embodiment of a golf bag having a golf bag handle operatively connected thereto.

FIGS. 7-13 show a golf bag 110 characteristic of embodiments of the present invention. The golf bag 110 may be a cart bag or a stand bag, for example. Referring to FIG. 7, the golf bag 110 includes one or more rigid members (not shown) operatively connecting a base 111 of the golf bag 110 to a top divider section 112 of the golf bag 110. The one or more rigid members are connected at their upper ends to the top divider section 112 and at their lower ends to the base 111. The one or more rigid members operate to support a bag portion 113 disposed therearound. The rigid member(s) may include support bars, polytubes/sheets of plastic, and/or any other material known or used by those skilled in the art to structurally support the bag portion of a golf bag.

The bag portion 113 is preferably constructed from some type of flexible material such as a cloth or vinyl material, although it is within the scope of embodiments of the present invention that the bag portion 113 is constructed from any type of material such as a more rigid material. One or more pockets 114, 115, 115A, 115B may optionally be connected to an outside of the bag portion 113 to enable storing and transporting of golfing equipment such as golf balls, golf tees, ball markers, and/or golf gloves. The areas within the pockets 114, 115, 115A, 115B may also optionally be segmented to provide organized storing and transporting of the above-mentioned golf equipment.

The base 111 and the top divider section 112 of the golf bag 110 are preferably constructed from a rigid or at least semi-rigid material, for example plastic or some type of metal. The base 111 is preferably generally solid across the lower portion of the golf bag 110 to allow resting of golf clubs thereon when the golf clubs are located within the golf bag 110.

Figure 8:
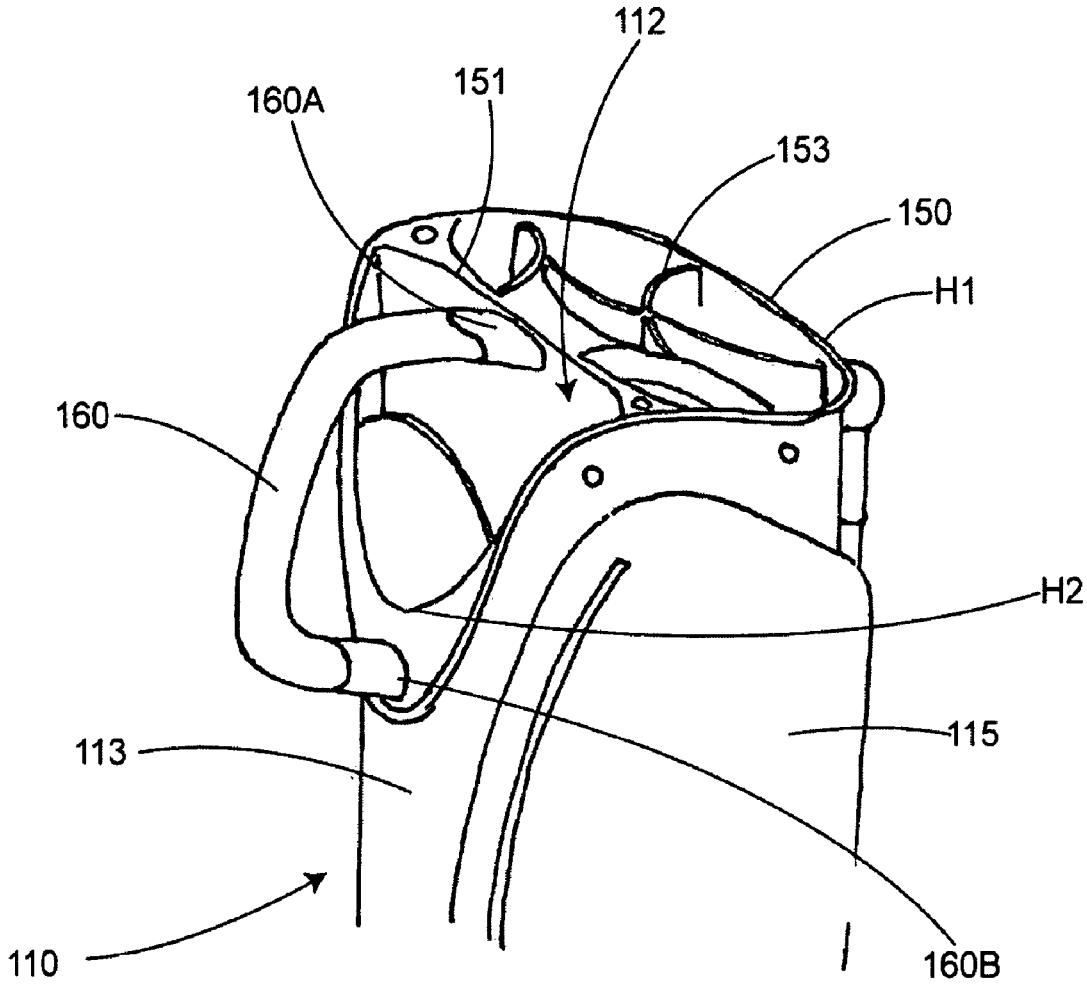
FIG. 8 is a perspective sectional downward view of the golf bag of FIG. 7 showing the handle operatively connected to a top divider section of the golf bag.

As shown in FIG. 8, the top divider section 112 includes a perimeter support portion 150 and a divider portion 151. Within the perimeter support portion 150 and the divider portion 151 are one or more club dividers 153 which are utilized to separate and organize golf clubs disposed within the golf bag 110. The perimeter support portion 150 and the divider portion 151 act together to provide perimeter support for and border the golf clubs and the club dividers 153. The perimeter support portion 150 of the top divider section 112 surrounds the club dividers 153 at a first height H1 around the back side of the golf bag 110 and then preferably dips downward to a second, lower height H2 around the front side of the golf bag 110. The back side of the golf bag 110 is preferably the side of the golf bag 110 which is farthest from a handle 160 of the golf bag 110, while the front side of the golf bag 110 is preferably the side of the golf bag 110 which is closest to the handle 160.

The divider portion 151 extends within and across a portion of the perimeter support portion 150 which is generally of the first height H1. The divider portion 151 and the perimeter support portion 150 may be constructed from the same material and may constitute one unitary piece, and the divider portion 151 and perimeter support portion 150 may optionally be made from the same mold. In the alternative, the perimeter support portion 150 and divider portion 151 may be constructed from different materials and/or may each constitute a separate piece, with the perimeter support portion 150 and the divider portion 151 operatively connected to one another, for example connected by bolts, screws, or an adhesive.

As illustrated in FIG. 8, the golf bag handle 160 has a first end 160A and a second end 160B. At least one end of the golf bag handle 160 is operatively connected to the top divider section 112. Most preferably, both ends 160A, 160B are operatively connected to the top divider section 112. Although it is contemplated that the golf bag handle 160 may be connected to any portion of the top divider section 112, it is preferred that the first end 160A of the golf bag handle 160 is connected to the outside of the divider portion 151 and that the second end 160B of the golf bag handle 160 is connected to the outside of the perimeter support portion 150 of the second, lower height H2. In any case, the golf bag handle 160 is positioned preferably at the uppermost position on the golf bag 110. Although the above description specifies a handle 160 having two ends 160A, 160B connected to the top divider section 112, it is contemplated that the handle 160 may have any number of ends, including even merely one end, connected to the top divider section 112.

The golf bag handle 160 may be of any length which is capable of fitting a user's hand. Preferably, the length of the golf bag handle 160, measured from the first end 160A to the second end 160B, ranges from approximately seven inches to approximately 9 inches, and the preferable diameter of the handle 160 ranges from approximately 0.75 inches to approximately 1 inch.

It is within the scope of embodiments of the present invention that the golf bag handle 160 may be constructed from the same material as the top divider section 112 or may be made of a different material than the material of the top divider section 112. However, it is preferable that the golf bag handle 160 is constructed from a material which causes the handle 160 to be rigid or at least semi-rigid. Preferably, the handle 160 is made of a plastic material. The handle 160 may be prepared in the same mold as the top divider section 112 and therefore the handle 160 and top divider section 112 become one integral piece, or in the alternative, the handle 160 may be rigidly connected to the top divider section 112, for example by one or more bolts or screws or an adhesive material. Preferably, the handle 160 and the top divider section 112 are both plastic injected parts made from polypropylene, polyethylene, ABS, and/or any other variety of plastic, or a copolymer of the above materials. Most preferably, the handle 160 and top divider section 112 are constructed from polypropylene, polyethylene, or a copolymer of polypropylene and polyethylene. A cloth material or some other material which provides comfort to the hand when gripping the handle 160 may optionally surround the handle 160. Some type of padding may also be provided around the handle 160 to provide additional comfort to the hand of the user.

Although it is possible for the handle 160 to be disposed at any orientation with respect to a centerline through the golf bag 110, in the most preferable embodiment of the golf bag 110, the handle 160 is vertically oriented substantially parallel to a centerline through the golf bag 110. The handle 160 is generally u-shaped.

Figure 13:
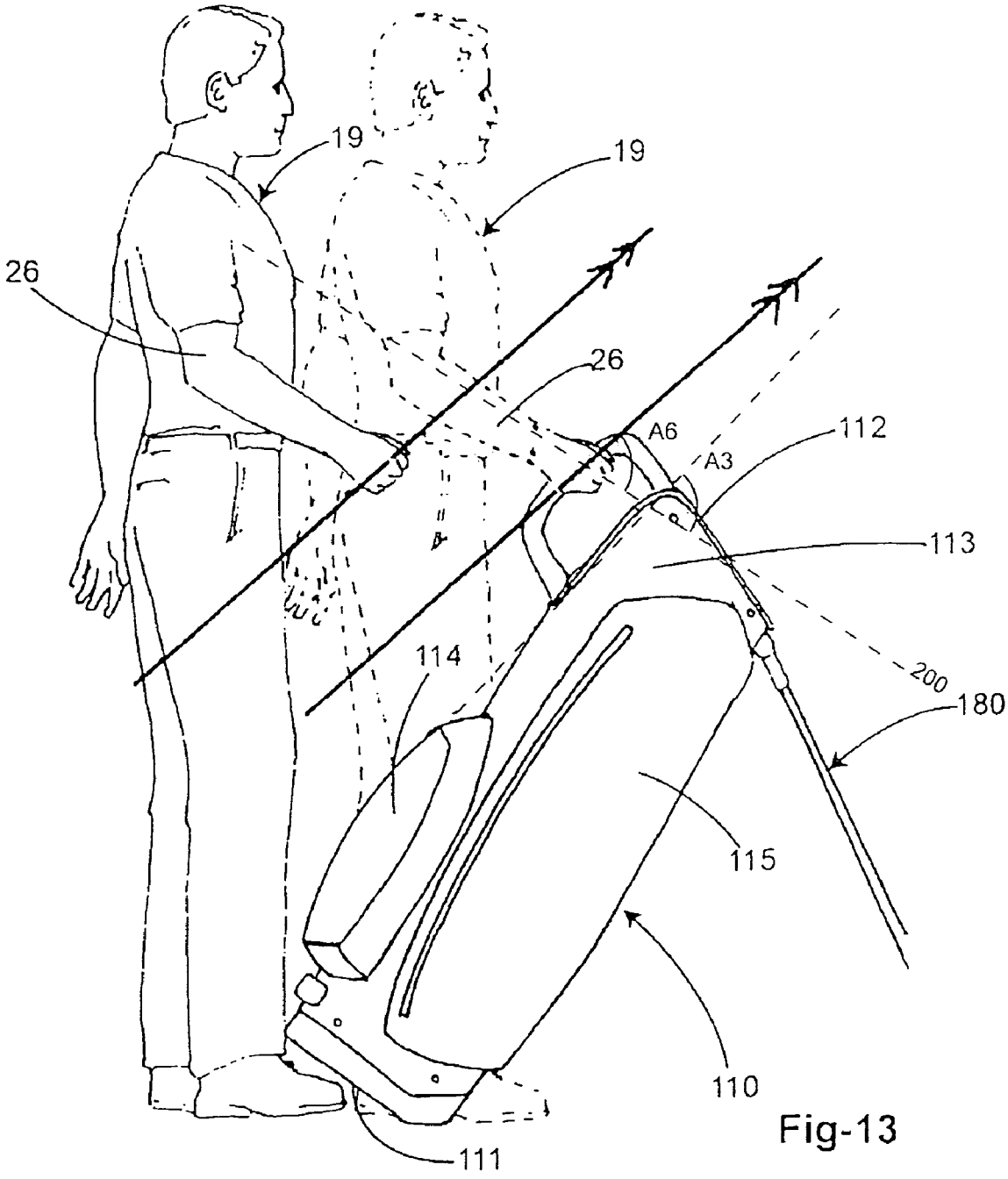
FIG. 13 is a side view of the golf bag of FIG. 7, showing the user lifting or setting down the golf bag using the handle, or showing the user applying force to activate the stand using the handle.

The handle 160 is ergonomically comfortable for the user 19 (see FIGS. 9 and 13) when the user 19 is grippingly engaging the handle 160 to carry and/or lift the golf bag 110 at least partially due to its angled relationship with respect to the golf bag 110. In this respect, the first end 160A of the handle 160 is preferably angled inward towards a centerline of the golf bag 110 with respect to the second end 160B. The ergonomic design of the golf bag handle 160 also results from its location at the upper end of the golf bag 110 and its connection to the at least semi-rigid top divider section 112. Preferably, the angle of the handle 160 ranges from approximately 10 degrees to approximately 15 degrees with respect to a longitudinal axis through the center of the golf bag 110. Also preferably, the handle 160 is disposed at an angle with respect to a line through a center of a lower portion of the arm 26 of the user 19, when the user 19 is in a position reaching for the golf bag 110, as shown in FIG. 13. The lower portion of the arm 26 of the user 19 is generally defined as the portion of the user's arm 26 below the elbow. Preferably, this angle ranges from approximately 30 degrees to approximately 50 degrees.

FIG. 7 shows an angle A1 of the handle 160 with respect to a centerline LAC of the golf bag 110 or with respect to a longitudinal axis LAC through the center of the golf bag 110. For illustrative purposes, the angle A1 is depicted in FIG. 7 through a centerline of the handle grip portion. FIG. 7 also illustrates an angle A2 of the divider portion 151 with respect to the centerline LAC of the golf bag 110 or with respect to the longitudinal axis LAC through the center of the golf bag 110.

A stand 180 is preferably pivotably connected to the back side of the golf bag 110. FIG. 7 shows the stand 180 in an activated position. Most preferably, the stand 180 is operatively connected to the back side of the top divider section 112. The stand 180 includes one or more stand legs 180A, 180B which act as a tripod in cooperation with the remainder of the golf bag 110 and another stand leg (not shown). The operation of the stand 180 may be integrally connected to the handle 160 so that the handle 160 may be utilized to transfer force for activating and/or deactivating the stand 180. Specifically, the stand legs 180A, 180B are preferably operatively connected to an upper end of an actuating wire (not shown), and the actuating wire is operatively connected to an actuating foot (not shown) at its lower end. Transmitting force to the foot trips the wire, causing the legs 180A, 180B to pivot outward with respect to the remainder of the golf bag 110.

Figure 12:
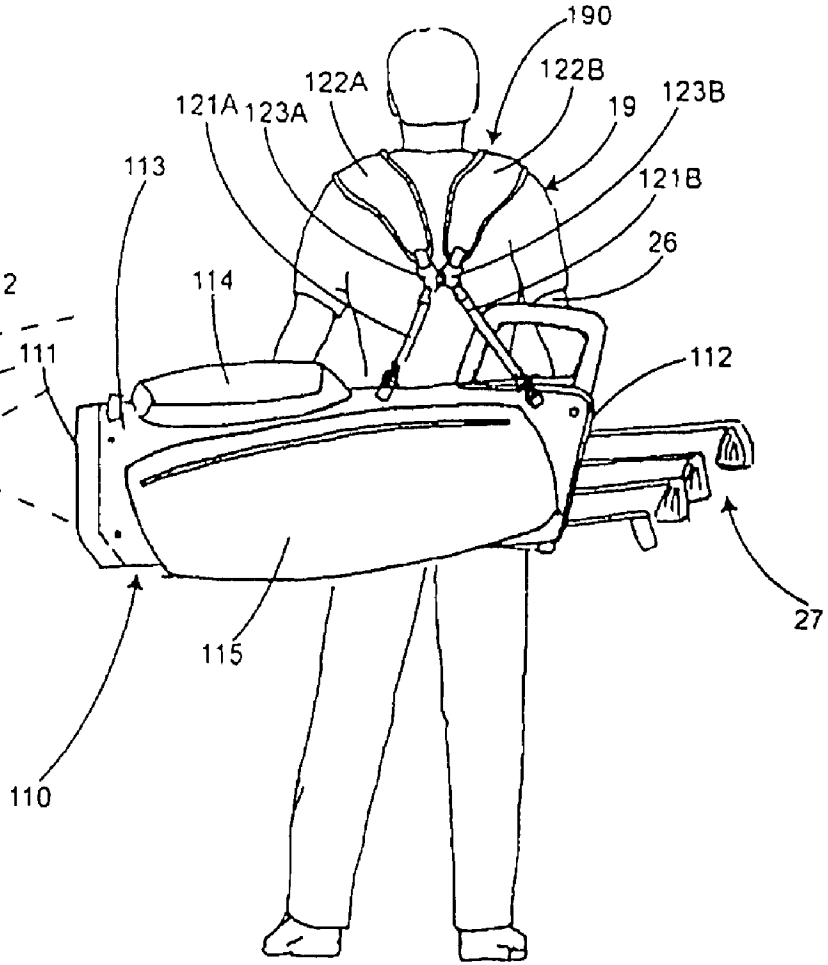
FIG. 12 is a side view of the golf bag of FIG. 7, illustrating the operation of the dual shoulder strap and handle of the golf bag.
Figure 11:
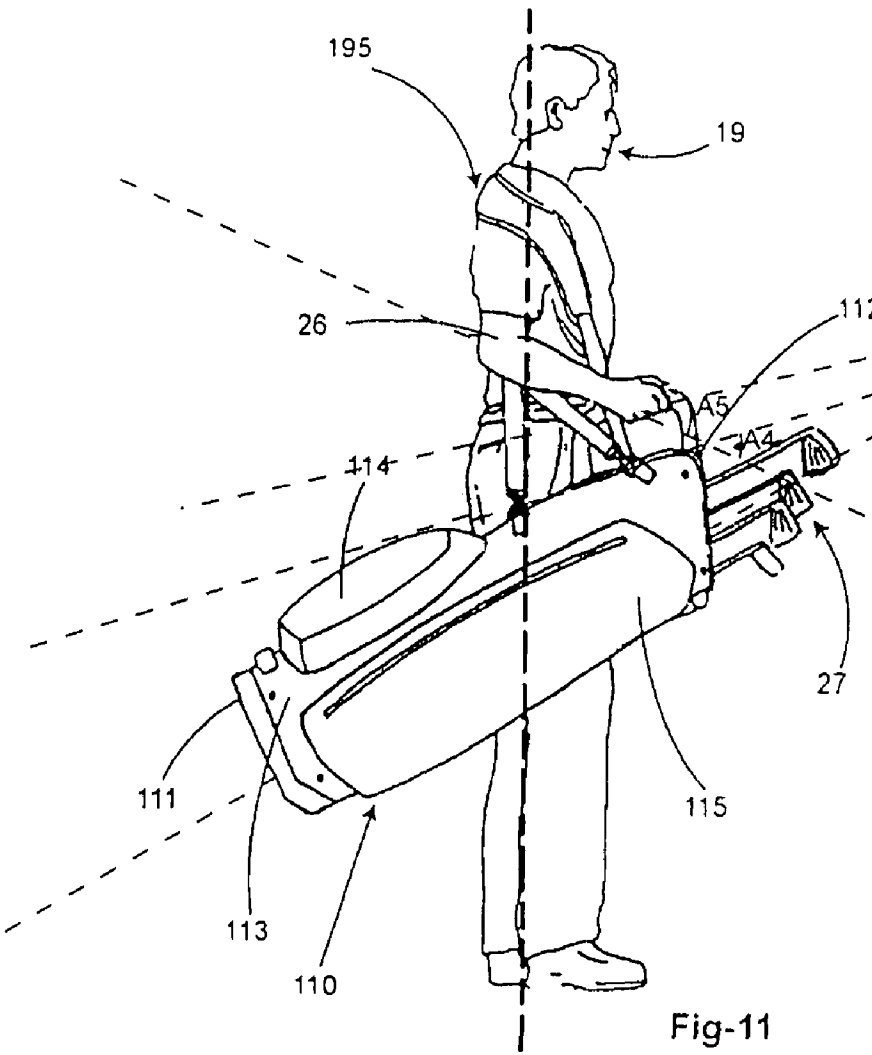
FIG. 11 is a side view of the golf bag of FIG. 7, illustrating the operation of the shoulder strap and handle of the golf bag.

As shown in FIGS. 11 and 12, the golf bag 110 may optionally include a dual shoulder strap 190 or a single shoulder strap 195, or both. Ends of the dual and/or single shoulder straps 190, 195 are operatively connected in at least two locations to the outside of the bag portion 113 of the golf bag 110, preferably substantially parallel to the connection points of the ends 160A, 160B of the golf bag handle 160.

The dual shoulder strap 195 may include a first strap portion 121A and a second strap portion 121B, a first connecting portion 123A and a second connecting portion 123B, and a first shoulder portion 122A and a second shoulder portion 122B. The strap portions 121A, 121B are connected to the bag portion 113, the shoulder portions 122A, 122B are placed around the shoulders of the user 19, and the connecting portions 123A, 123B connect the shoulder portions 122A, 122B to the strap portions 121A, 121B. The dual shoulder strap 195 is also preferably connected to the golf bag 110 at two additional connection points (not shown) across the golf bag 110 from the connection points of the shoulder strap portions 121A, 121B to the golf bag 110, as shown and described in U.S. Pat. No. 6,457,620 issued to Batten et al. on Oct. 1, 2002, which is herein incorporated by reference in its entirety.

Figure 1:
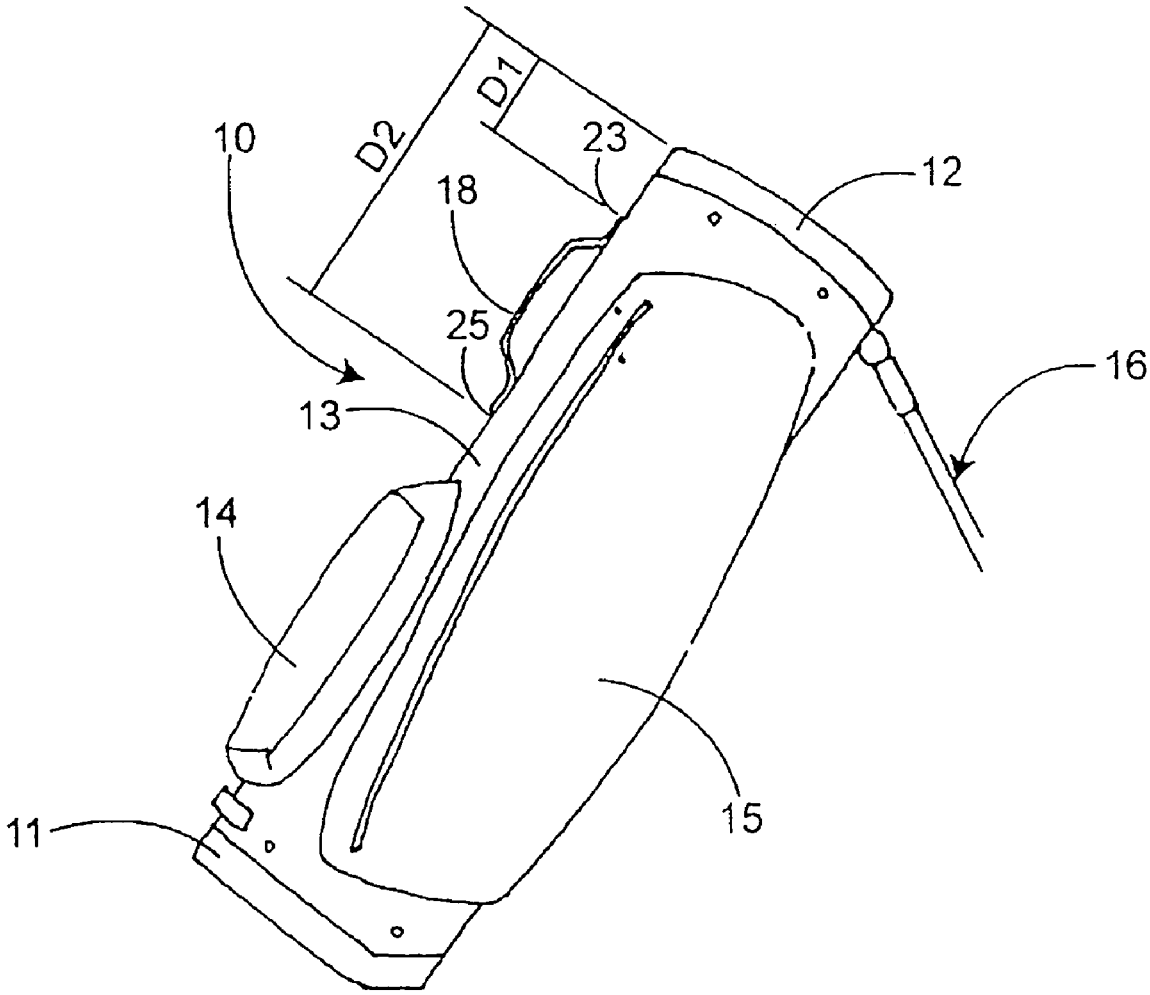
FIG. 1 is a side view of a typical golf bag with a stand of the golf bag activated.
Figure 3:
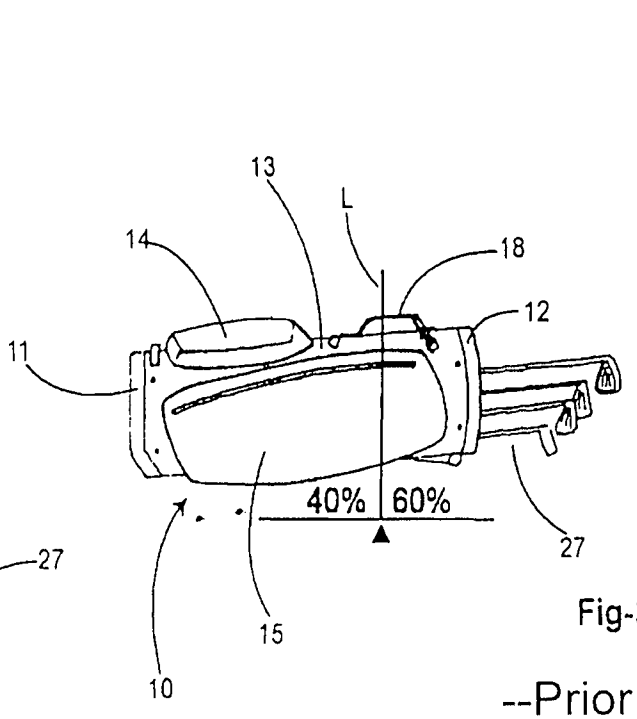
FIG. 3 is a side perspective view of the golf bag of FIG. 1 illustrating the weight distribution of the golf bag.
Figure 2:
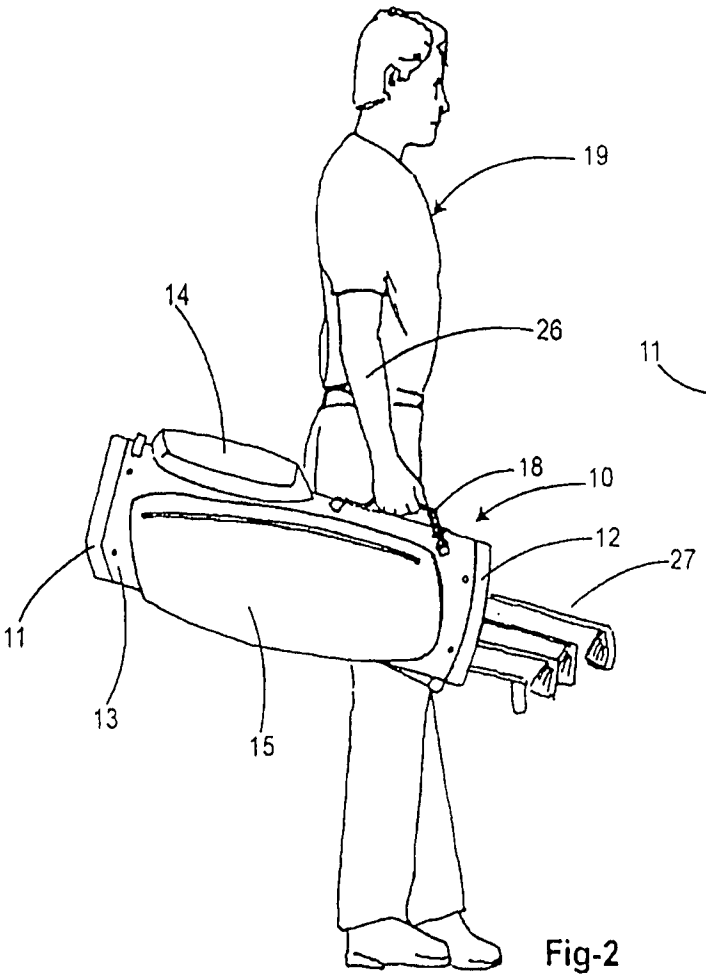
FIG. 2 is a side view of a user carrying the typical golf bag of FIG. 1.
Figure 4:
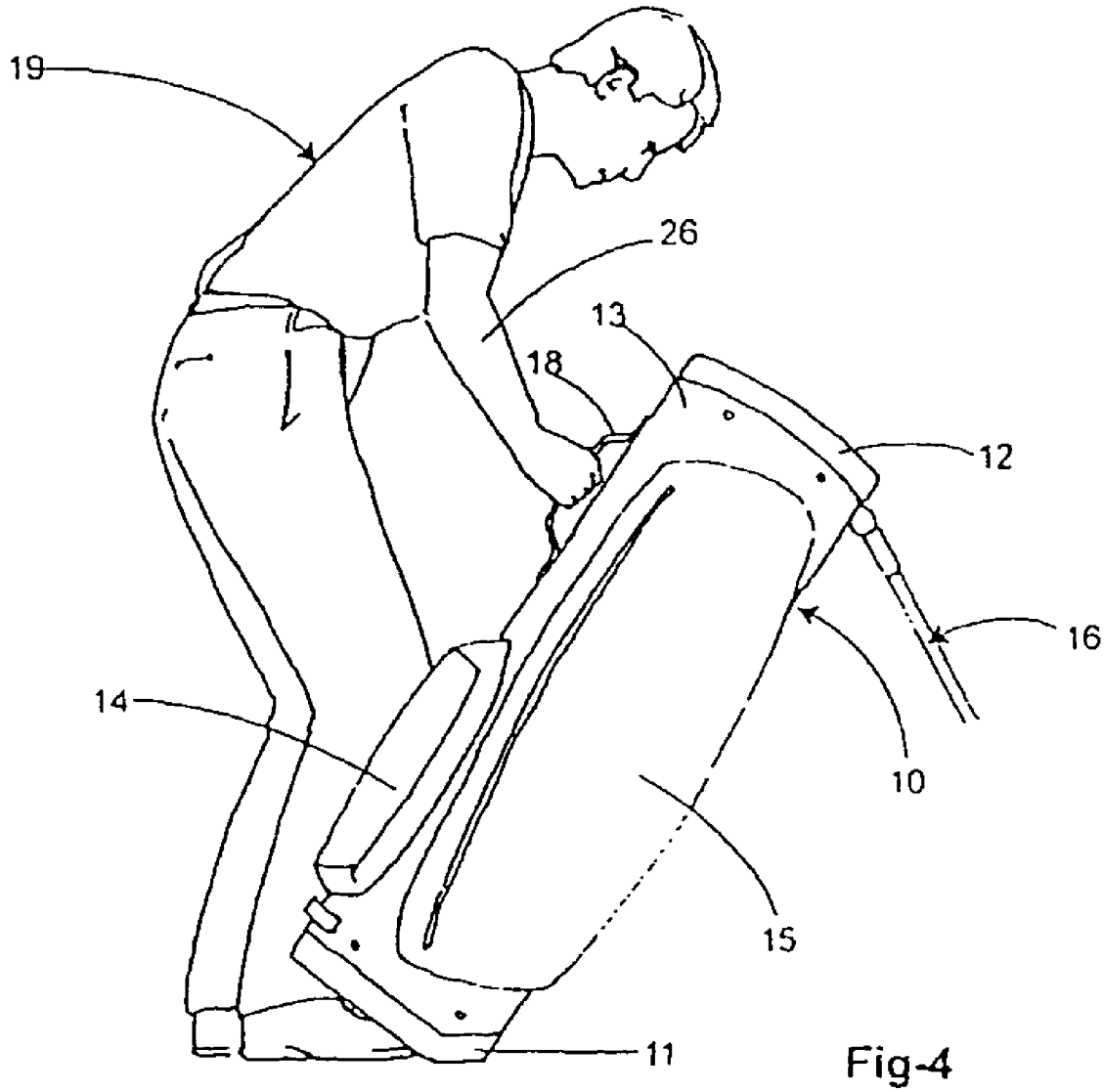
FIG. 4 is a side view of the user picking up or setting down the typical golf bag using the handle.
Figure 6:
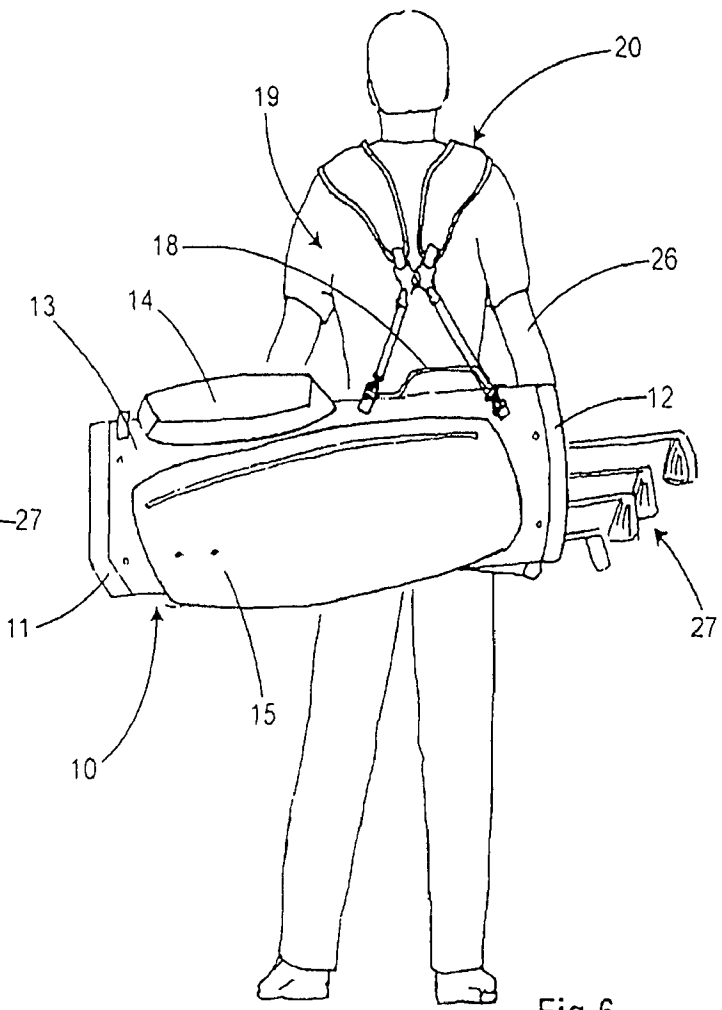
FIG. 6 is a side view of a typical golf bag illustrating the operation of the dual shoulder strap and handle of the golf bag of FIG. 1.
Figure 5:
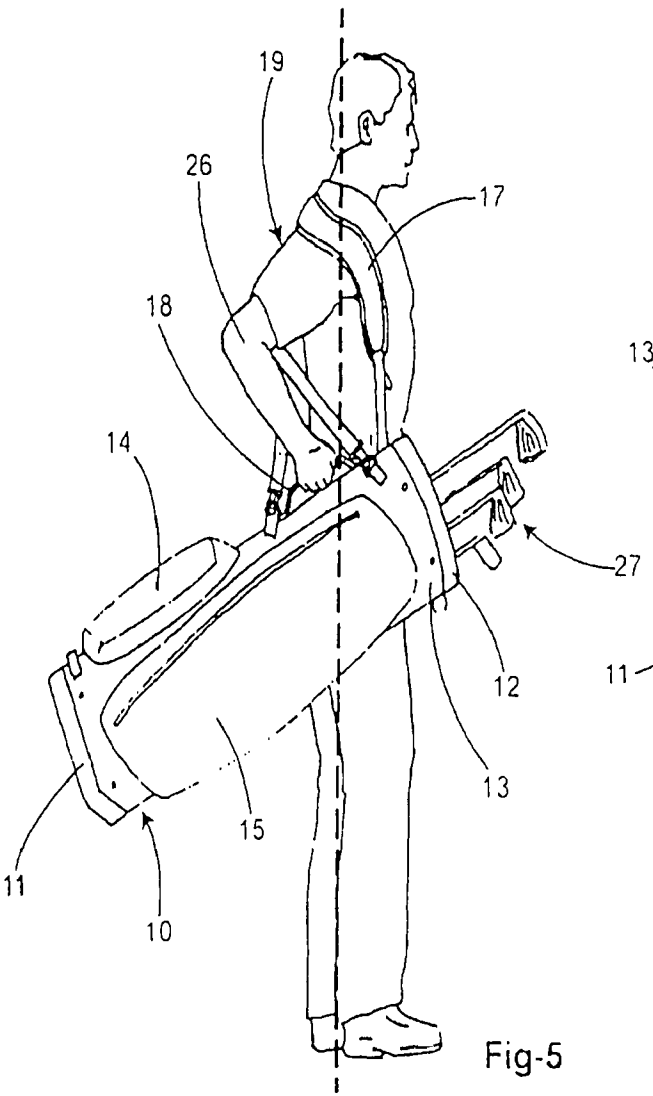
FIG. 5 is a side view of a typical golf bag illustrating the operation of the shoulder strap and handle of the golf bag of FIG. 1.
Figure 9:
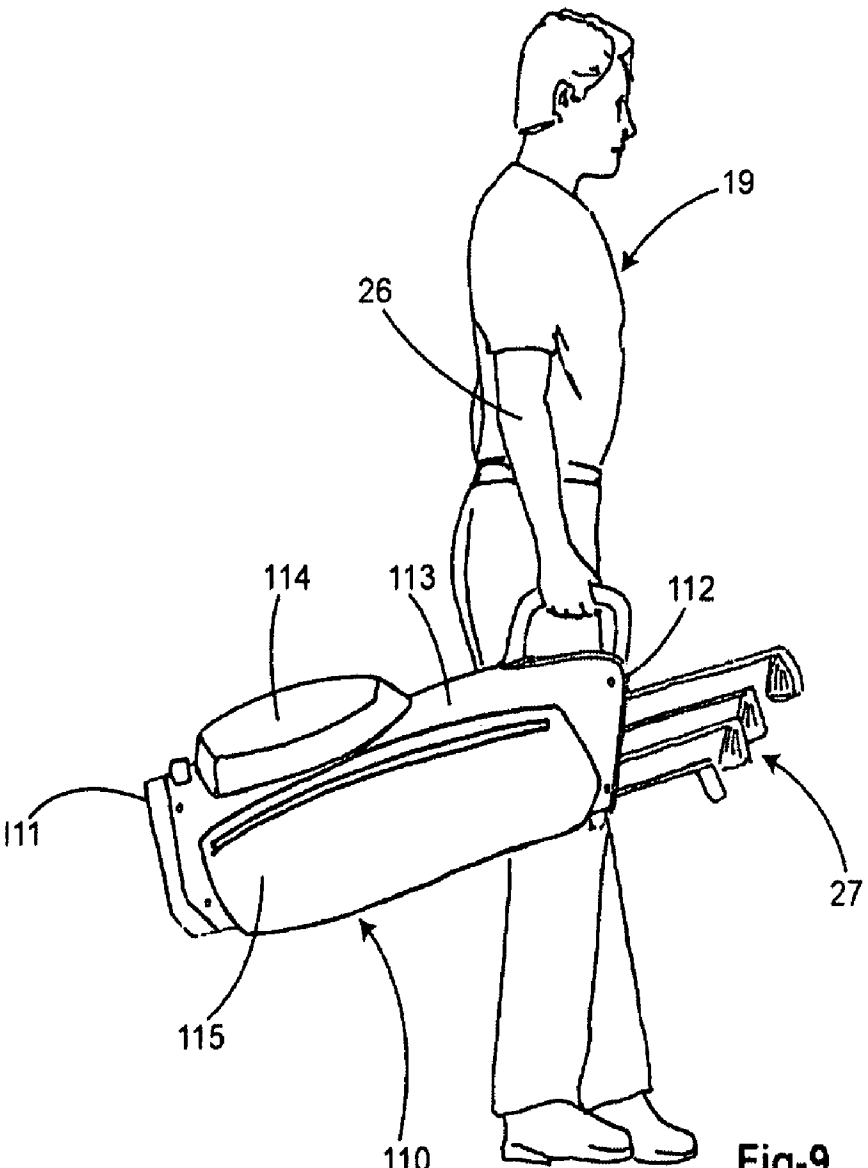
FIG. 9 is a side view of the golf bag of FIG. 7 being carried by a user using the golf bag handle with the user's arm in the optimal comfort position.

The operation of the golf bag handle 160 and the golf bag 110 incorporating the golf bag handle 160 is generally as follows. Referring first to FIG. 9, the user 19 may carry the golf bag 110 by gripping the handle 160 with the user's hand. With the user's arm 26 in an optimal comfortable and ergonomically pleasing, generally extended position, the golf bag 110 is capable of retaining the golf clubs 27 therein and the golf clubs 27 are not in danger of falling from the golf bag 110, as is the case when using the golf bag 10 shown in FIG. 2 and described above in relation to FIGS. 1-6.

Figure 10:
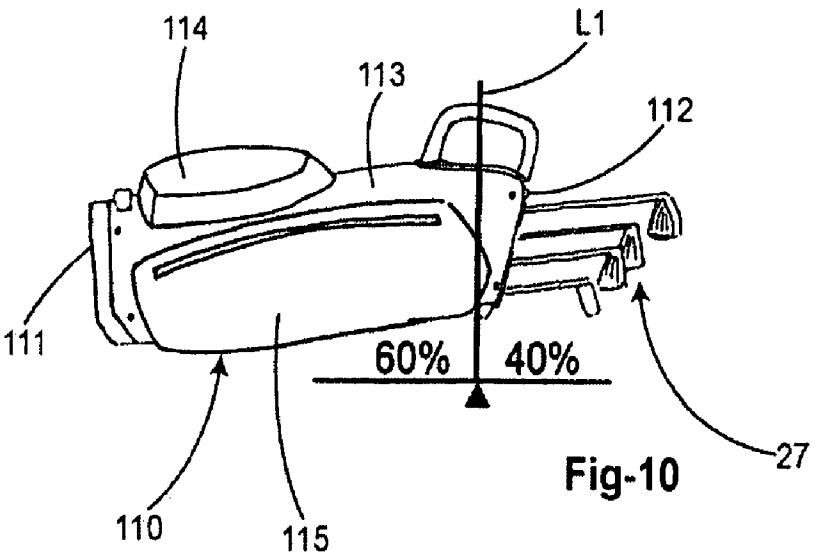
FIG. 10 is a side perspective view of the golf bag of FIG. 7, illustrating the weight distribution of the golf bag.

FIG. 10 illustrates the favorable load distribution of the golf bag 110 of embodiments of the present invention with the golf clubs 27 located therein which prevents the golf clubs 27 from falling from the golf bag 110 in the optimal carrying position of the user 19 shown in FIG. 9. As opposed to the ordinary load distribution of the typical golf bag 10 shown in FIG. 3 and described above in relation to FIG. 3, the golf bag 110 with the ergonomic handle 160 thereon allows approximately 60% of the load of the golf bag 110 to exist on the rear end of the golf bag 110 and only approximately 40% of the load of the golf bag 110 to exist on the front end of the golf bag 110, where the front end and the rear end are defined by an approximate center line L1 through the handle 160.

As shown in FIG. 11, the golf bag handle 160 is also ergonomically pleasing and comfortable for the user 19 when the user 19 moves the load of the golf bag 110 from the user's shoulder to the user's hand by transferring the load from the single shoulder strap 195 on the user's shoulder to the golf bag handle 160 by gripping the handle 160 with the user's hand, and vice versa. Specifically, as shown in FIG. 11, when the single shoulder strap 195 is disposed on a shoulder of the user 19, the user 19 may comfortably and ergonomically place his or her arm 26 forward of his or her body to grippingly engage the handle 160 using his or her hand. Because of the location of the handle 160 and its presence at the rigid top divider section 112, the user's arm 26 is in a comfortable position when transferring the load of the golf bag 110 from the user's shoulder to the user's hand, for example to allow the user 19 to place the golf bag 110 on the ground. This comfortable and ergonomic method of transferring the golf bag 110 from the user's shoulder to the user's hand is in contrast to the uncomfortable method of transferring the golf bag 110 shown and described in relation to FIG. 5. As described above in relation to FIG. 5, the user 19 must extend his or her arm 26 backwards behind his or her body to grippingly engage the prior art handle 18 of the golf bag 10 when the golf bag 10 is initially located on the user's shoulder. The golf bag handle 160 is further comfortable for the user 19 when the user 19 desires to transfer the load of the golf bag 110 from the user's hand to the user's shoulder.

FIG. 11 shows an angle A4 of the user's arm 26 (via a centerline drawn through the user's arm from the elbow to the wrist) with respect to a divider portion 151 of the golf bag 110 when the golf bag handle 160 is grippingly engaged by the user's hand 26 in the position shown in FIG. 11. Also illustrated is an angle A5 of the user's arm 26 with respect to the handle grip portion of the handle 160 when the golf bag handle 160 is grippingly engaged by the user's hand 26 in the position shown in FIG. 11. This angle A5 is illustrated via a line drawn through a center of the user's arm 26 from the elbow to the wrist and a line drawn through a centerline of the handle grip portion.

Referring now to FIG. 12, the ergonomic golf bag handle 160 additionally allows the user 19 to grip the handle 160 with the user's hand while the golf bag 110 remains on the user's shoulders by way of the dual shoulder strap 190. The user 19 may comfortably and ergonomically grip the golf bag handle 160 using his or her hand to enable removal of the golf bag 110 from the user's shoulder and transfer the load of the golf bag 110 from the user's shoulder to the user's hand, and vice versa. The outward angle of the handle 160 permits the user 19 to grippingly engage the handle 160 with his or her hand more easily than gripping the prior art handle 18. As shown and described above in relation to FIG. 6, prior art handles 18 did not easily permit the user 19 to grippingly engage the handles 18 when the golf bag 10 rested on the user's back due to the dual shoulder strap 20.

Finally, as depicted in FIG. 13, the ergonomic golf bag handle 160 provides comfortable and ergonomic access to the golf bag 110 when either picking up the golf bag 110 from the ground or when placing the bag on the ground and activating the stand 180. As shown and described in relation to FIG. 4, the user 19 must crouch or bend down to grip the handle 18 of the typical prior art golf bag 10, causing the user 19 to occupy an uncomfortable and un-ergonomic position. In contrast, the golf bag handle 160 and golf bag 110 of embodiments of the present invention allow the user to stand generally upright when either lifting the golf bag 110 to remove the golf bag 110 from the ground or when placing the golf bag 110 on the ground and/or activating the stand 180. Additionally, the user 19 may merely transmit force directly through the top divider section 112 using the handle 160 to activate and/or deactivate the stand 180. Generally, when the user 19 is gripping the handle 160 as shown in FIG. 13, the angle in which the golf bag handle 160 is disposed generally matches the angle of the user's palm with at least substantially no bending of the user's body.

FIG. 13 shows an angle A3 of the user's arm 26 (via a centerline 200 drawn through the user's arm 26 from the elbow to the wrist) with respect to a divider portion 151 of the golf bag 110 when the golf bag handle 160 is grippingly engaged by the user's hand 26 in the position shown in FIG. 13. FIG. 13 further shows an angle A6 of the user's arm 26 (via the centerline 200 drawn through the user's arm 26 from the elbow to the wrist) with respect to a line through a centerline of the gripping portion of the handle 160.

To construct the golf bag 110 shown and described above in relation to FIGS. 7-13, the support bars (not shown) are operatively connected at their upper ends to the top divider section 112 and at their lower ends to the base 111. The bag portion 113 is disposed around the support bars and operatively connected to the top divider section 112 and to the base 111. The one or more pockets 14, 15, 15A, 15B may be connected to the outside of the bag portion 113 before or after placing the bag portion 113 around the support bars and connecting the bag portion 113 to the golf bag 110.

The top divider section 112 may either be pre-fabricated to include the golf bag handle 160 thereon prior to its incorporation into the golf bag 110, or in an alternate embodiment, the top divider section 112 may be incorporated into the golf bag 110, and then the golf bag handle 160 may be connected to the top divider section 112 thereafter. At any time during the process, a cloth material may be disposed around the golf bag handle 160, the top divider section 112, and/or the club dividers 153. Also at any time, the stand 180 may be operatively connected to the top divider section 112 and either or both of the shoulder straps 190, 195, as desired, may be operatively connected to the golf bag 110. Although present in the preferred embodiment of the present invention, the stand 180 and shoulder straps 190, 195 are optional components of the golf bag 110 and are not necessarily present in all embodiments of the present invention.

Embodiments of the present invention are not limited to a golf bag 110 including the single shoulder strap 195 and the dual shoulder strap 190 described above; rather, the single shoulder strap and/or dual shoulder strap may be configured, fabricated, and/or connected to the golf bag 110 as shown or described in any of the following patents, each of which is incorporated by reference herein in its entirety: U.S. Pat. No. 6,457,620 issued to Batten et al. on Oct. 1, 2002; U.S. Pat. No. 2,853,111 issued to Williams on Sep. 23, 1958, U.S. Pat. No. 5,038,984 issued to Izzo on Aug. 13, 1991, U.S. Pat. No. 5,042,703 issued to Izzo on Aug. 27, 1991, U.S. Pat. No. 5,042,704 issued to Izzo on Aug. 27, 1991, and U.S. Pat. No. 6,006,974 issued to Varney et al. on Dec. 28, 1999. Therefore, as described in some of the above-incorporated patents, the shoulder strap 190 or 195 may be attached to the golf bag at two, three, four, or more than four points on the golf bag 110, for example by attaching hooks to the golf bag 110 at each location. Furthermore, as described in the above-incorporated U.S. Pat. No. 6,457,620, the golf bag 110 may include only one shoulder strap which is convertible between a single shoulder strap and a dual shoulder strap. In addition to the methods of connection and configurations of the shoulder straps described in the above-incorporated patents, it is contemplated that the shoulder straps 190, 195 may be configured, formed, and connected to the golf bag 110 in any way known to those skilled in the art.

Directional terms utilized in the above description, including "upward," "downward," "front," "back," etc., are not limiting terms, but are merely descriptive of the location of components of the present invention in relation to one another. The top divider section 112 may also be referred to as an equipment divider section. Although the user 19 depicted in FIGS. 7-13 is shown as using his or her right hand to manipulate the golf bag 110, embodiments of the present invention are equally applicable when the user 19 utilizes his or her left hand to manipulate the golf bag 110.

While the foregoing is directed to embodiments of the present invention, other and further embodiments of the invention may be devised without departing from the basic scope thereof, and the scope thereof is determined by the claims that follow.

The invention claimed is:

1. A golf bag, comprising:

a bag body;

an equipment divider section provided at an upper portion of the bag body and comprising a perimeter support portion and a divider portion connected to the perimeter support portion to form a perimeter around one or more equipment dividers; and a handle having a first connecting portion connected to the divider portion, a second connecting portion connected to the perimeter support portion, and a gripping portion between the first and second connecting portions, wherein a line through the gripping portion of the handle is spaced apart from and is disposed generally along an adjacent line to a central longitudinal axis running through the bag body.

2. The golf bag of claim 1, wherein the equipment divider section is located at an uppermost portion of the golf bag.

3. The golf bag of claim 2, wherein the line through the gripping portion of the handle is disposed at an outward angle with respect to the central longitudinal axis running through the center of the bag body.

4. The golf bag of claim 3, wherein the first connecting portion is operatively connected to the golf bag at a location closer to the longitudinal axis than the second connecting portion.

5. The golf bag of claim 3, wherein the angle ranges from approximately 10 degrees to approximately 15 degrees with respect to the longitudinal axis through the bag body.

6. The golf bag of claim 1, wherein the gripping portion of the handle is disposed at an angle with respect to a line through a center of a lower portion of an arm of a user in a reaching position for the golf bag, the lower portion of the arm beginning proximate to an elbow of the user.

7. The golf bag of claim 6, wherein the angle ranges from approximately 30 degrees to approximately 50 degrees.

8. The golf bag of claim 1, wherein the equipment divider section and the handle are constructed from the same material, the equipment divider section capable of dividing equipment when the equipment is disposed in the bag body.

9. The golf bag of claim 1, wherein the equipment divider section and the handle are molded together, the equipment divider section capable of dividing equipment when the equipment is disposed in the bag body.

10. The golf bag of claim 1, wherein the gripping portion of the handle is positioned ergonomically at an angle with respect to the central longitudinal axis through the bag body, the angle substantially eliminating bending of a body of the user when picking up the golf bag.

11. The golf bag of claim 1, further comprising a stand incorporated into the equipment divider section, wherein a force for activating the stand is transmitted to the stand through the handle.

12. The golf bag of claim 1, wherein the gripping portion of the handle is disposed on the golf bag at an angle with respect to the central longitudinal axis through the bag body, wherein the handle provides a load distribution when the golf bag is lifted by the handle where a load at a bottom portion of the golf bag is higher than a load at an upper portion of the golf bag, the upper and lower portions generally defined at a location through a centerline of the handle.

13. The golf bag of claim 1, wherein the first and second connecting portions are directly connected to the equipment divider section.

14. The golf bag of claim 1, wherein the handle is generally half-rectangular shaped.

15. The golf bag of claim 1, wherein the line through the first and second connecting portions is disposed substantially parallel to a line through at least two connecting portions of a shoulder strap operatively attached to the golf bag.

16. The golf bag of claim 1, wherein a load distribution of the golf bag in an optimal carrying position of the user's arm is approximately 40% of a golf bag load existing on a front end of the golf bag and approximately 60% of the golf bag existing on a back end of the golf bag, the front end and back end separated by a line through a center of a grip portion of the handle.

17. The golf bag of claim 1, wherein the equipment divider section extends at least a length from the first connecting portion to the second connecting portion.

18. The golf bag of claim 1, wherein the bag body surrounds a substantial portion of the equipment divider section.

19. A golf bag, comprising:

a bag body;

an equipment divider section provided at an upper portion of the bag body, said equipment divider section comprising a perimeter support portion defining a perimeter of the upper portion of the bag and a divider portion provided inside the perimeter; and a handle having a first connecting portion connected to the divider portion, a second connecting portion connected to the perimeter support portion, and a gripping portion between the first and second connecting portions.

20. The golf bag of claim 19, wherein the second connecting portion is attached to the equipment divider section outside the perimeter.

21. The golf bag of claim 19, wherein a line through the first and second connecting portions lies substantially in a same plane as a central longitudinal axis running through the bag body.

* * * * *